US006735788B2

(12) United States Patent
Chen-Lieh

(10) Patent No.: US 6,735,788 B2
(45) Date of Patent: May 18, 2004

(54) BUCKLE STRUCTURE OF SWIMMING MASK

(75) Inventor: Pan Chen-Lieh, Ilan Hsing (TW)

(73) Assignee: QDS Injection Molding LLC, Rancho Santa Fe, CA (US)

( * ) Notice: Subject to any disclaimer, the term of this patent is extended or adjusted under 35 U.S.C. 154(b) by 0 days.

(21) Appl. No.: 10/274,136

(22) Filed: Oct. 21, 2002

(65) Prior Publication Data

US 2004/0073988 A1 Apr. 22, 2004

(51) Int. Cl.[7] ..... A61F 9/02
(52) U.S. Cl. ..... 2/428; 2/426
(58) Field of Search ..... 2/426, 428, 439, 2/446, 452; 351/43, 44, 153

(56) References Cited

U.S. PATENT DOCUMENTS 4,978,209 A * 12/1990 Ohba ..... 351/153
5,511,251 A * 4/1996 Brakas ..... 2/452
5,555,571 A * 9/1996 McCaffrey ..... 2/428
5,898,471 A * 4/1999 Simioni et al. ..... 351/153
6,047,410 A * 4/2000 Dondero ..... 2/426
6,405,384 B1 * 6/2002 Chiang ..... 2/428

OTHER PUBLICATIONS

US 2003/0101507, Cleary et al., Jun. 5, 2003.*

* cited by examiner

*Primary Examiner*—Gary L. Welch
(74) *Attorney, Agent, or Firm*—Troxell Law Office PLLC

(57) ABSTRACT

A buckle structure for a swimming mask having a soft mask body, at least one lens, a buckle and a strap. The mask body and lens are integrally combined. The buckle is connected to the mask body by a plurality of pins, which reduces the deformation of the mask body due to the bearing strength of the buckle.

1 Claim, 2 Drawing Sheets

BUCKLE STRUCTURE OF SWIMMING MASK

BACKGROUND OF THE INVENTION

The present invention is related to a buckle structure of mask for, but not limited to, swimming, scuba as well as diving. Said structure is provided between the soft mask part and strap, more particular to the buckle structure of frameless swimming mask.

At present, conventional and known swimming masks normally provide a soft mask, a set of frame and at least one or more lens. The buckle is jointed or mounted to both sides of frame directly. The structure is complicated.

Currently, the swimming masks are adopting a frameless structure, that means, the soft mask part is connected with lens directly and the buckle is provided on the soft mask part near the outside of lens. The advantage of this mask is that it can provide wider view and without obstruction. As refer to FIG. 1, in order to prevent the misshape of soft mask B which caused by the unequal pulling strength during adjusting or operating buckle A, there is an insert-through pin C to increase the surface area and share the pulling force across the soft mask B. Furthermore, around the insert-through pin C, a gluey portion D is provided with certain thickness which extends from the soft mask B. The prior art reduces the deformity of the soft mask B, but introduces an obstruction from the insert-through pin C and agley portion D.

SUMMARY OF THE INVENTION

After carefully study, the inventor developed the present invention. The buckle structure of the present invention is adopting a hard buckle which has plurality of pins inserted into holes located on the soft mask. The pins are located equally on the larger surface of soft mask part which enables the pulling force caused by operating and adjusting the strap to be spread in different directions thus decreasing the deformity of mask. Therefore, there is no insert-through pin protruded in the inner portion of the mask part, so that a wider view angle is provided.

DESCRIPTION OF THE PREFERRED EMBODIMENTS

Figure 1:
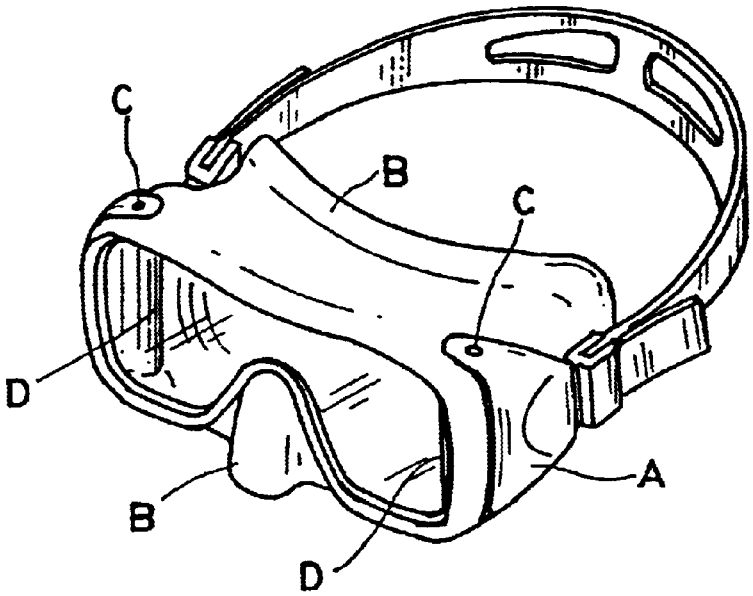
FIG. 1 PRIOR ART
FIG. 1 is the prospective view of the conventional swimming mask.
Figure 2:
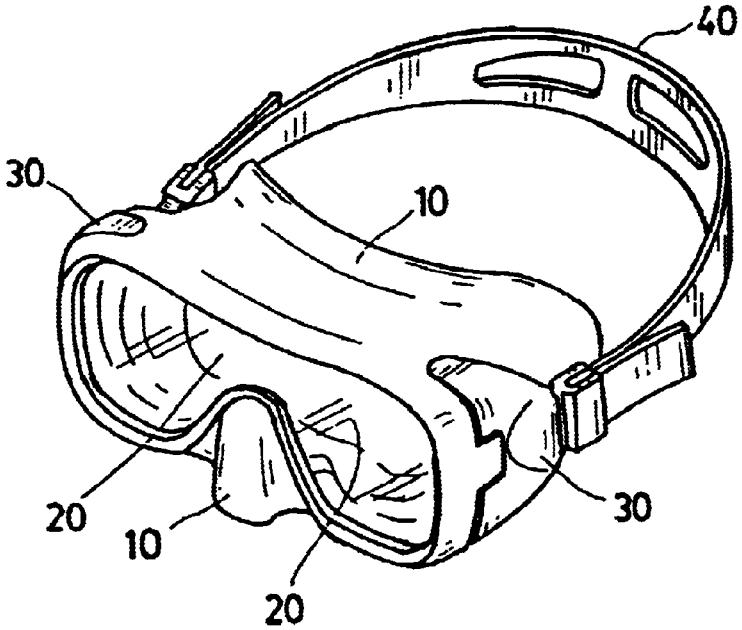
FIG. 2 is the prospective view of the present invention.
Figure 3:
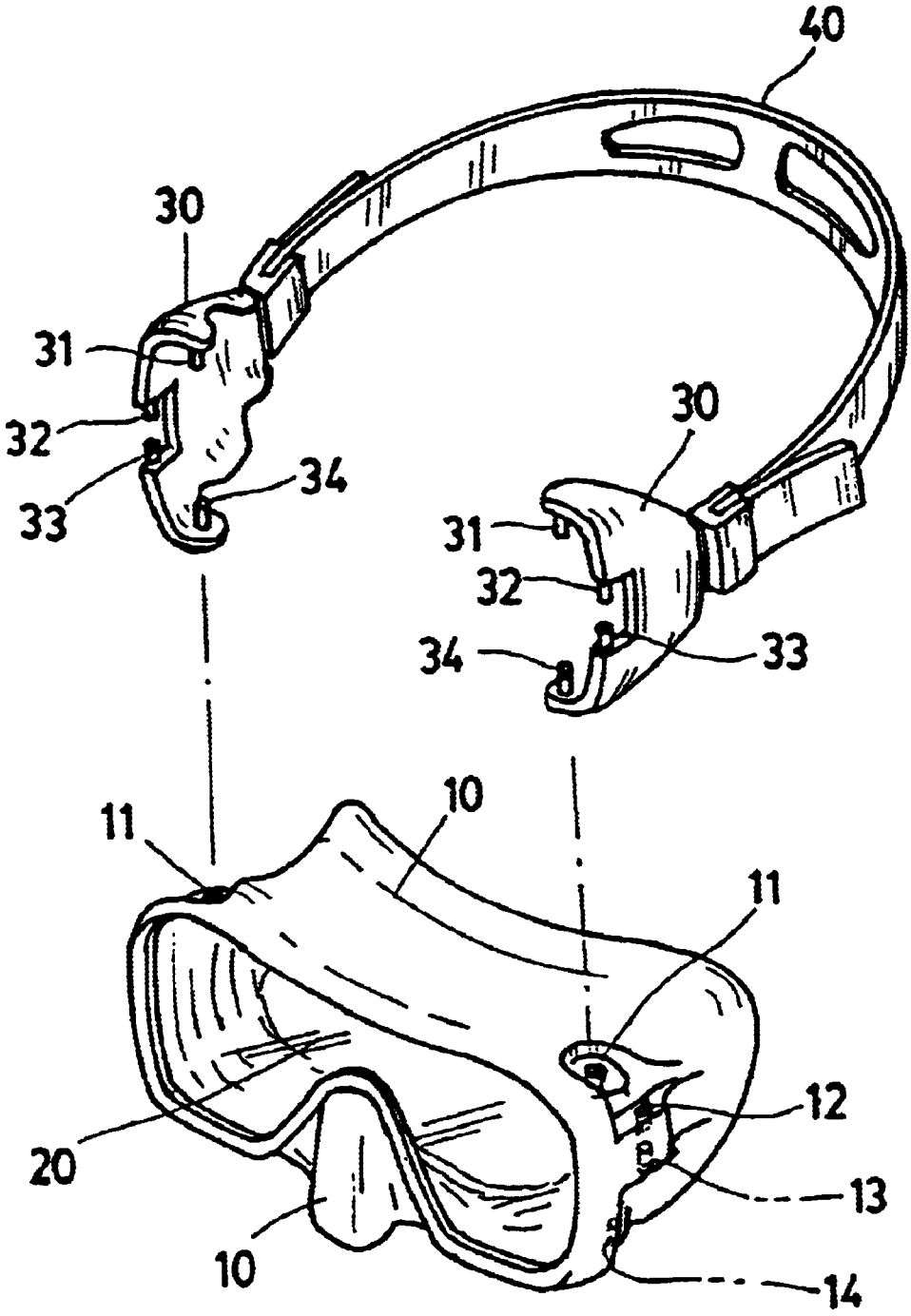
FIG. 3 is the exploit view of the present invention.

As shown in FIG. 2 and FIG. 3, the structure of the swimming mask of the present invention includes a mask body 10, lens 20, buckles 30 and a strap 40. Wherein the mask body 10 is made of a soft material and the lens 20 are made of tempered glasses or a similar material. The mask body 10 and at least one lens 20 can be integrally made during a forming process. The buckle 30 and strap 40 can be connected and the looseness of the strap 40 can be adjusted. The structure and combination of buckles 30 and strap 40 vary and are not the subject matter of the present invention. The feature of the present invention is the combination of the structure of the buckle 30 and the mask body 10.

The mask body 10, near the outside of lens 20, are a plurality of pin-holes 11, 12, 13 and 14 which are positioned to produce the least deformity of mask body 10 when bearing the pulling force from buckle 30.

The structure of buckle 30 is made by hard material and the shape can be similar to a conventional one. The buckle 30 has a plurality of pins 31, 32, 33 and 34. The soft mask body 10 is easily deformed, which enables the pins to be inserted into the pin-holes 11, 12, 13 and 14 and fixed stably. When the pins are inserted into the pin-holes, the force bore by the buckle 30 will be shared by each pin-hole 11, 12, 13 and 14 and the deformation of mask body 10 can be reduced.

In conclusion, the design feature of multiple fasten points between the mask body 10 and buckle 30 effectively spreads and distributes the force coming from buckle 30 and bore by mask body 10 to reduce the deformity of mask body 10. The result and advantage is that the mask body is not easily misshaped by the force from operating and adjusting the strap, and further provides a wider view angle.

What is claimed is:

1. A buckle structure for a swimming mask comprising:

a) two buckles, each buckle having two pairs of pins spaced apart and extending from the buckle in opposite directions;

b) a mask body having:

i) at least one lens connected to the mask body; and ii) four pairs of pin holes, two pairs of pin holes located on each of two opposing sides of the mask body, the two pairs of pins on each of the two buckles aligning with and being inserted into one of the two pairs of pins holes in the mask body; and c) a strap adjustably connected at each of two opposing ends to one of the two buckles.

* * * * *